US006223450B1

(12) United States Patent
Banerjee

(10) Patent No.: US 6,223,450 B1
(45) Date of Patent: May 1, 2001

(54) APPARATUS FOR MULTI-NIP IMPULSE DRYING

(75) Inventor: Sujit Banerjee, Marietta, GA (US)

(73) Assignee: Institute of Paper Science and Technology, Atlanta, GA (US)

( * ) Notice: Subject to any disclaimer, the term of this patent is extended or adjusted under 35 U.S.C. 154(b) by 0 days.

(21) Appl. No.: 09/633,304

(22) Filed: Aug. 8, 2000

Related U.S. Application Data

(60) Division of application No. 09/371,729, filed on Aug. 10, 1999, which is a continuation-in-part of application No. 09/018,164, filed on Feb. 3, 1998, now Pat. No. 6,006,442, which is a continuation of application No. 08/719,343, filed on Sep. 25, 1996, now Pat. No. 5,718,059.

(51) Int. Cl.[7] ..... F26B 11/02; D06F 58/03

(52) U.S. Cl. ..... 34/116; 34/123; 34/132

(58) Field of Search ..... 34/61, 95, 116, 34/117, 123, 132; 100/37, 38, 51, 59, 302, 303; 162/206, 207, 208, 358.1, 359.1; 264/70, 109, 113, 123

(56) References Cited

U.S. PATENT DOCUMENTS

| | | | | |
|---|---|---|---|---|
| 4,324,613 | * | 4/1982 | Wahren | 162/111 |
| 5,082,533 | * | 1/1992 | Pulkwski et al. | 34/116 X |
| 5,272,821 | * | 12/1993 | Orloff et al. | 34/110 |
| 5,778,555 | * | 7/1998 | Lehtinen et al. | 34/116 X |
| 6,105,276 | * | 8/2000 | Ensign et al. | 34/116 X |

* cited by examiner

*Primary Examiner*—Stephen Gravini
(74) *Attorney, Agent, or Firm*—Fitch, Even, Tabin & Flannery

(57) ABSTRACT

A continuous process for the dewatering of a wide variety of solid-liquid matrices, including primary and secondary sludge, involves the simultaneous application of pressure and heat to solid-liquid matrices.

7 Claims, 7 Drawing Sheets

The IPST laboratory simulator

APPARATUS FOR MULTI-NIP IMPULSE DRYING

This is a division of prior application Ser. No. 09/371,729, filed Aug. 10, 1999, which is a continuation-in-part of prior application Ser. No. 09/018,164, filed Feb. 3, 1998, now U.S. Pat. No. 6,006,442, which is a continuation of U.S. application Ser. No. 08/719,343, filed Sep. 25, 1996, now U.S. Pat. No. 5,718,059, issued Feb. 17, 1998, which is hereby incorporated herein by reference in its entirety.

FIELD OF THE INVENTION

The present invention generally relates to the dewatering of solid-liquid matrices. More particularly, the invention provides a continuous process for removing water from various types of solid-liquid matrices, including various types of sludge, with the simultaneous application of both pressure and heat to the solid-liquid matrices.

BACKGROUND OF THE INVENTION

Solid-liquid matrices from municipal, industrial and other processes are currently dewatered with a room-temperature belt, filter or screw press. These pieces of equipment employ high-pressure processes during which the water is separated from the solid-liquid matrices.

An energy efficient means to dewater a solid-liquid matrix is through the use of impulse drying. "Impulse drying" occurs when a wet paper web passes through the press nip of a pair of rolls, one of which has been heated to a high temperature. A steam layer adjacent to the heated surface grows and displaces water from the wet sheet of paper in a more efficient manner than conventional evaporative drying.

Impulse drying is described in U.S. Pat. No. 4,324,613. In the method described in this patent, the surface of one of the rolls is heated to a high temperature by an external heat source immediately prior to passing the wet paper web between the heated roll and the other roll. This patent describes the use of solid rolls having at least a surface layer having high thermal conductivity and high thermal diffusivity, such as copper or cast iron, for use as the heated roll.

U.S. Pat. No. 4,324,613 discloses that, in normal cases, a major part of the drying must take place in the press nip, and final drying takes place after the nip. The conductivity of the material of which the heating roll is made must be high so as not to dry at roll surface temperatures higher than necessary. A high conductivity is stated to mean that the heat can be conducted to a greater depth in the roll, and even extracted from a greater depth, which in itself means that a lower roll temperature can be used. U.S. Pat. No. 4,324,613 discloses that the choice of material is limited by the risk of thermal fatigue and, in this respect, at least the surface layer of the roll should be made of a material for which the quantity:

$$\frac{\sigma u(t-v)\sqrt{\rho}\,c\lambda}{Ea_c}$$

has a high value desirably at least $0.6\times10^6$, where $\sigma\mu$ is the fatigue strength, v is Poisson's ratio, ρ is the density, c is the specific thermal capacity, λ is the thermal conductivity, E is the modulus of elasticity, and a is the coefficient of thermal expansion for the material. Copper alloys are stated to have the highest values, approximately $13\times10^6$. However, they are stated to have rather poor resistance to wear and to not be suitable for doctoring. Other stated suitable materials are duralumin ($0.7\times10^6$), cast iron ($0.67\times10^6$–$0.85\times10^6$), steel ($0.8\times10^6$) and nickel (approximately $0.8\times10^6$–$0.9\times10^6$).

In addition to the impact on energy consumption, impulse drying also has an effect on paper sheet structure and properties. Surface fiber conformability and interfiber bonding are enhanced by transient contact with the hot surface of the roll. As the impulse drying process is usually terminated before the sheet is completely dried, internal flash evaporation results in a distinctive density profile through the sheet that is characterized by dense outer layers and a bulky midlayer. For many paper grades, this translates into improved physical properties. The persistent problem with the use of impulse drying, however, is that flash evaporation can result in delamination of the paper sheet. This is particularly a problem with heavy weight grades of paper. This has been a major constraint as to the commercialization of impulse drying.

U.S. Pat. No. 2,209,759 discloses a press roll assembly having a hard, porous surface roller adapted to receive water pressed from a wet web of paper for conveyance of the water away from the web of paper, and having a second roller. During the conveyance of the water away from the wet web of paper, some of the water is thrown from the roller by centrifugal force, and remaining portions of the water are sucked or blown out of the roller at points spaced from the web of paper by a mechanical suction device cooperating with the outer face of the roller. Column 2, Lines 25≧39, on Page 3 of this patent discloses the direction of a flame against the porous surface of the first roller after the removal of water from the web of paper to heat the surface of the roller and continuously supply dewatered and heat-treated pores to the nip of the press roll assembly.

U.S. Pat. No. 2,679,572 discloses a roll having a resilient heated surface for use in drying operations. The heating element which is pressed in the roll is in the form of a layer of electro-conductive plastic composition surrounding an insulating layer, and having sufficient resistance to provide the desired heating action when a difference in electrical potential is maintained across the layer. In order to supply electrical energy or potential to the conductive layer, conductor rings of brass or copper are embedded in the conductive layer. Contact points present in the roll are connected to a suitable source of electrical potential so that a difference of potential is maintained across the conductive layer as a shaft rotates. The resistance of the conductive layer causes heat to be generated uniformly thereover, by which the surface of the roll is heated.

U.S. Pat. No. 4,424,613 described a method and a machine for brushing the pile of a pile fabric, such as a knit fabric, and for removing the wrinkles in a moving web of the material. The wrinkles are removed from the fabric by a wrinkle remover with the application of heat by an infrared heater, and then the fabric is brushed by one or more rotating brushes. The wrinkle remover consists of a pair of rectangular spreader boxes, each of which is connected to a suitable vacuum source through conduit. The vacuum conduit sucks air through an opening to pull the fabric down and maintain it in contact with the bristles of the brushes. As the fabric is being supplied over the spreader boxes, the brushes cam the fabric outward to remove the wrinkles therein as the suction pressure from the vacuum conduit pulls the fabric downward.

U.S. Pat. No. 4,874,469 discloses an apparatus and method in which a formed web is subjected for an extended period of time to increased pressure and temperature, such that fluid within the web is removed therefrom. The apparatus includes a press member (or backing roll), such that when the web passes through the pressing section of the apparatus, fluid is removed from the web, and a heating means which is adjacent to the press member, and which transfers heat to the web. When the web passes through the press section, the web is subjected for an extended period of time to increased pressure and temperature. Water vapor resulting from this high pressure and temperature which is generated in the pressing section of the apparatus during passage of the web therethrough is stated to force the fluid in the liquid phase away from the web. The press member defines a pressing surface which is porous, for inhibiting delamination of the web.

U.S. Pat. No. 4,888,095 discloses a method for extracting water from a wet paper web in a paper making machine using a ceramic foam component which has: (1) a supporting structure; and (2) a water permeable member mounted on the supporting structure which is adapted to support a paper web. The paper web is supported on a moving porous belt, and passes over the water permeable member. When a pressure differential is applied to the wet paper web as it travels over the water permeable member, moisture is extracted from the wet paper web and drains through the water permeable member.

U.S. Pat. No. 5,327,661 and U.S. Pat. No. 5,272,821 disclose a method and apparatus (an electrohydraulic press) for drying a wet web of paper utilizing impulse drying techniques to provide a paper product having a predetermined pattern of delaminated fibers. The wet paper is dried as it passes through the press nip when it is transported through a pair of rolls wherein at least one of the rolls has been heated to an elevated temperature (to a temperature of from about 200° C. to about 500° C.). The heated roll is provided with a planar surface having a predetermined pattern formed on the surface of a material having a low K value of less than about 3000 w·s/mc, and having a relatively low porosity. The material forming the predetermined pattern of the roll surface is preferably selected from ceramics, polymers, glass, inorganic plastics, composite materials and cermets. The remainder of the roll surface has a high K value of greater than about 3000. The material forming the remainder of the roll surface is preferably selected from steel, molybdenum, nickel and duralumin. The two rolls are urged together to provide a compressive force on the wet paper web as it is transported through the rolls. This method is stated to be useful for the impulse drying of paper webs having an initial moisture level of from about 50% to about 70%. The moisture level of the paper web after being subjected to this impulse drying technique is stated to be in the range of from about 40% to about 60%.

U.S. Pat. No. 5,353,521 and U.S. Pat. No. 5,101,574 disclose a method and apparatus for drying a wet web of paper utilizing impulse drying techniques. The wet paper web is transported through a pair of rolls wherein at least one of the rolls has been heated to an elevated temperature (a temperature of from about 200° C. to about 400° C.) for a residence time of up to about 0.125 seconds. The heated roll is provided with a surface having a low thermal diffusivity of less than about $1\times10^{-6}$ $m^2/s$. The method is stated to be useful for the impulse drying of paper webs having an initial moisture level of from about 50% to about 70%. The moisture level of the paper web after it has been subjected to this impulse drying technique is stated to be in the range of from about 40% to about 60%.

SUMMARY OF THE INVENTION

The present invention provides an improved continuous process for dewatering a solid-liquid matrix which has a structure and for dewatering a solid-liquid matrix that does not have a structure. In accordance with the present invention, it has been described that the sequential and multiple applications of a hot surface to a solid-liquid matrix simultaneously with the application of pressure to the solid-liquid matrix unexpectedly leads to the greatly enhanced removal of water from the solid-liquid matrix. In an important aspect, the process of the invention is effective to provide an solid-liquid matrix where the solid-liquid matrix has at least about 10 weight percent solids, based on the weight of the dewatered solid-liquid matrix.

In accordance with the present invention, pressure and heat are simultaneously applied to a solid-liquid matrix having a structure through impulse rollers. In an important aspect of the invention, a first heat and pressure and applied for a period of time effective for removal of an initial amount of moisture from the solid-liquid matrix. Following the first applications of heat and pressure, at least a second heat and pressure are simultaneously applied for a period of time effective for removal of additional moisture from the solid-liquid matrix.

In an alternative aspect of the invention, the process further includes applying a mesh to the solid-liquid matrix during the application of pressure and heat. The mesh is effective for preventing spreading and/or overflow of the solid-liquid matrix.

In another aspect, the process further includes applying a belt containing impressions, such as a honeycomb configuration, to the solid-liquid matrix during the application of pressure and heat. The belt with impressions generally serves as an upper belt of the impulse dryer. This belt is effective for preventing spreading and/or overflow of the solid-liquid matrix.

In yet another aspect, the present invention also provides a method for dewatering a solid-liquid matrix which does not have a structure. In accordance with this aspect of the invention, the solid-liquid matrix that does not have a structure is first treated in a manner such that the weight percent solids content of the solid-liquid matrix increases to a level which provides the solid-liquid matrix with a structure. The solid-liquid matrix thus provided is then treated as indicated above.

DETAILED DESCRIPTION

The processes of the present invention are an improvement over currently-employed methods for dewatering solid-liquid matrices, including sludge, which generally consist of the pressing of the solid-liquid matrices with a room-temperature press (i.e., dewatering the solid-liquid matrices by squeezing the water therefrom by the application of a great amount of pressure). The processes of the present invention advantageously have been shown to significantly increase the amount of water being removed from certain solid-liquid matrices in comparison with the dewatering of the same solid-liquid matrices by the currently-employed methods for dewatering solid-liquid matrices.

Definitions

For purposes of clarity, the terms and phrases used throughout this specification and in the appended claims are defined in the manner set forth directly below.

The term "dewatering" as used herein means the removal of water from a solid-liquid matrix.

Figure 1:
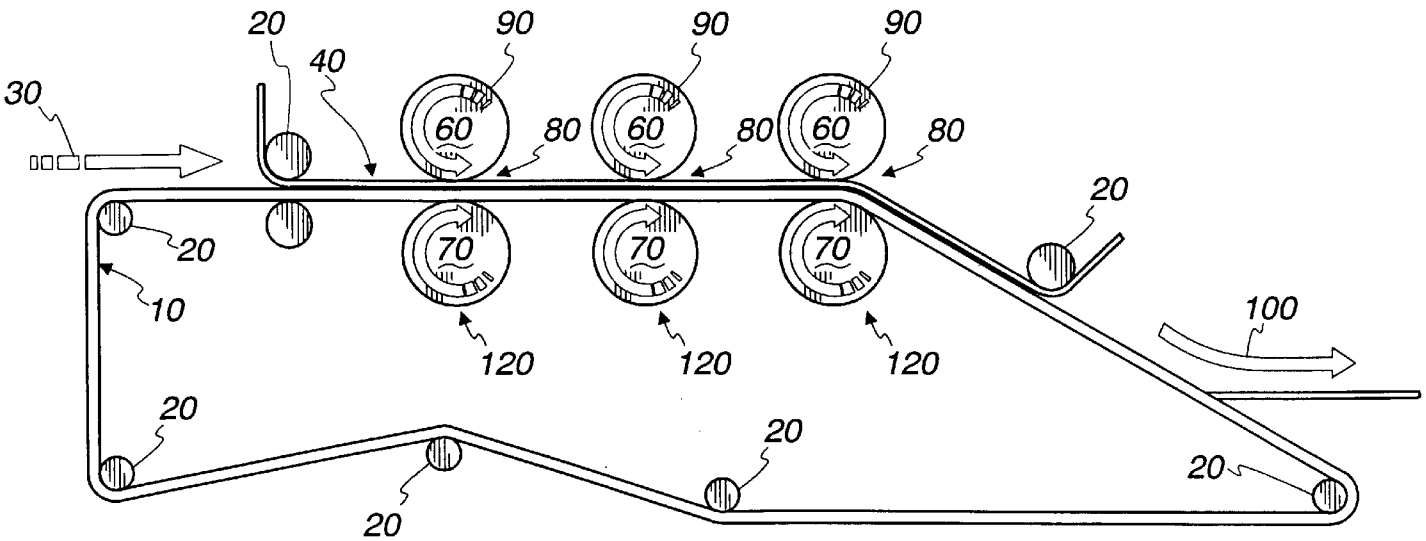
FIG. 1 illustrates the continuous impulse dewatering system of the invention.
Figure 4:
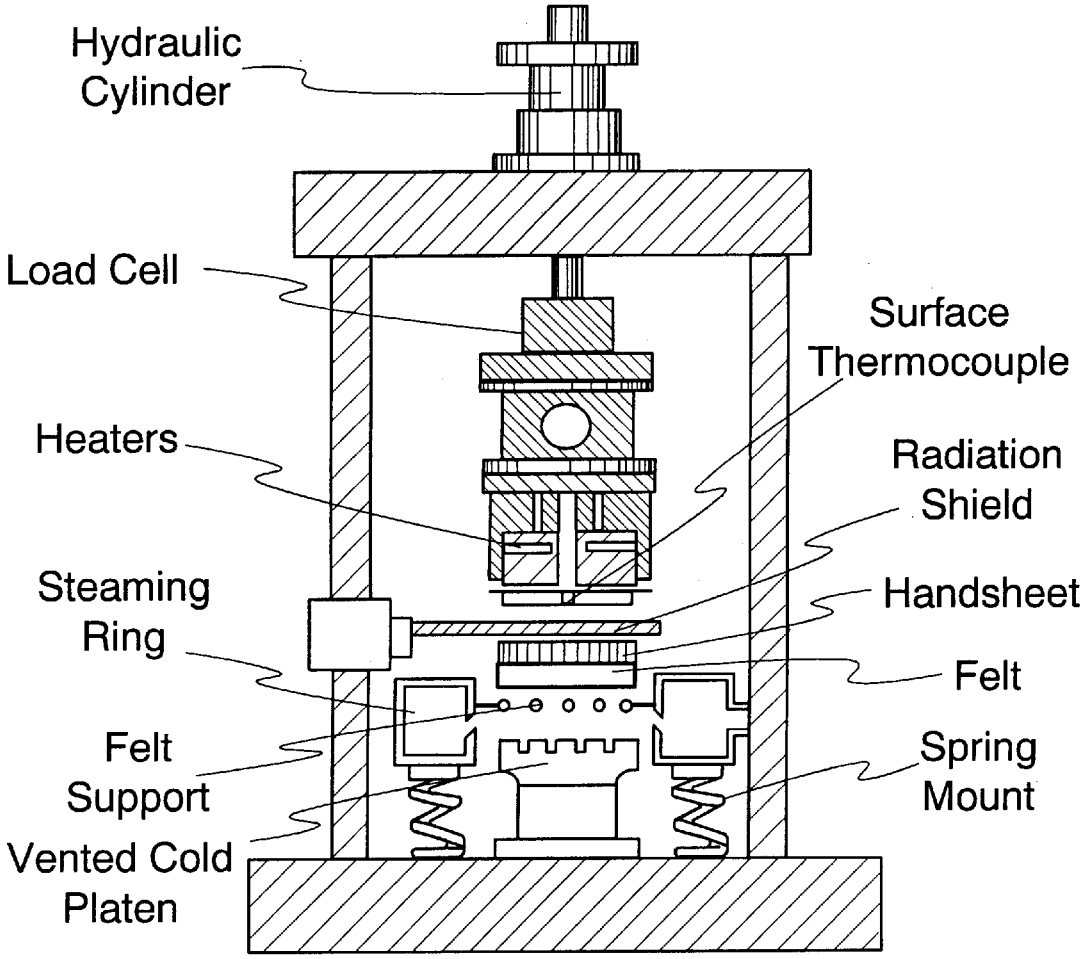
FIG. 4 is a diagram of the electrohydraulic impulse drying laboratory press simulator employed in the experiment described hereinbelow in Example 1, in which paper mill primary clarifier sludge samples were dewatered by the method of the present invention.

The phrases "dwell time" and "nip residence time" as used herein mean the amount of time (generally in seconds or milliseconds) during which sludge or another solid-liquid matrix is brought into contact with the heated rolls of the electrohydraulic impulse drying press simulator shown in FIG. 1 and FIG. 4, or the amount of time pressure and heat are simultaneously applied to the solid-liquid matrix by other pieces of equipment.

The phrases "impulse drying" and "hot pressing" as used herein mean the simultaneous application of heat and pressure to sludge, or to another solid-liquid matrix, for example, with a piece of equipment, such as a hot press or an impulse dryer, which will simultaneously apply heat and pressure to the solid-liquid matrix.

The phrases "impulse roll" and "impulse roller" as used herein mean a roller which has been heated in some manner to a temperature above room temperature. Such a roller may be added to a conventional filter or belt press in order to carry out the methods of the present invention.

The phrases "municipal sludge," "industrial sludge" and "secondary sludge" as used herein mean sludge derived from municipal and/or industrial operations, which generally consists mostly of organic materials of biological origin, such as debris from microorganisms, which may be admixed with waste solids from industrial processing, which are present in water. The solids portion of municipal sludge generally consists mainly of debris from microorganisms.

The phrases "paper mill sludge" and "primary sludge" as used herein mean sludge generally derived from the primary settling basin of a primary clarifier, which consists principally of non-bonded pieces of fiber and other solids derived from pulp processing and paperhanging which are present in water. The solids portion of paper mill sludge taken from a primary clarifier generally consists mainly of fiber and other residual material from the papermaking process.

The phrase "peak pressure" as used herein means the maximum pressure applied to a material with a roller or other device used to transfer heat, and is measured in units of psi.

The phrase "primary clarifier" as used herein means a settling basin where the solids in a flowing water stream settle out. When collected, these solids form primary sludge.

The phrases "solid-liquid matrix" and "solid-liquid matrix" as used herein include any solid-liquid mixture, and means a material or combination of materials which contains from about 0% to about 100% of organic solid particles, such as organic materials of biological origin, for example, waste solids, from about 0% to about 100% of inorganic solid particles, such as fiber and other solid particles or chemical residues derived from pulp processing papermaking, and from about 0% to about 100% of water, and various combinations or mixtures thereof. The solid-liquid matrix may include web-like and non web-like material. In the aspect of the invention where the solid-liquid matrix includes non web-like materials, the solid particles present in the solid-liquid mixture or matrix are not bonded together in any manner and, thus, do not form a web or other like structure. Examples of solid-liquid mixtures and solid-liquid matrices include, but are not limited to, various types of sludge, such as paper mill sludge, municipal sludge and industrial sludge, and mixtures or combinations thereof. The solid-liquid mixtures and solid-liquid matrices may have a slimy and/or goopy appearance and/or feel, or may have a dry texture, appearance and/or feel, or may have some other type of appearance and/or feel. Solid-liquid mixtures and solid-liquid matrices which have a slimy and/or goopy appearance and/or feel, and which have been "dewatered" in accordance with methods of the present invention, may have a less slimy and/or goopy appearance and/or feel because some of the liquid which was initially present in the solid-liquid mixtures and solid-liquid matrices will have been removed therefrom by these methods.

Types of solid-liquid matrices

The methods of the present invention may be employed to dewater any type of solid-liquid matrix including, but not limited to, primary sludge and secondary sludge of municipal, industrial or other origin as well as paper webs. As described in detail hereinbelow, any type of solid-liquid matrix can be treated in a manner known by those of skill in the art to increase the weight percent solids content of the solid-liquid matrix to a level which provides a structure to the solid-liquid matrix, in order to give the solid-liquid matrix a "body." Methods within the present invention may subsequently be employed to dewater this treated solid-liquid matrix.

Generally, solid-liquid matrices which have a weight percent solids content of about 10% or less (a weight percent water content of about 90% or more) do not have a structure (are not of a form which can be held or which can free stand). Some solid-liquid matrices which have a weight percent solids content of between about 10% and about 20%, such as about 15%, or even higher, may not have a structure. Different types of solid-liquid matrices will become structured at different levels of weight percent solids content. The level of weight percent solids content at which a particular solid-liquid matrix will form a structure may be determined by those of skill in the art.

Prior to dewatering solid-liquid matrices according to methods within the present invention, solid-liquid matrices which do not have a structure should be treated in a manner known by those of skill in the art, such as with a conventional, room-temperature belt or filter press, or by mixing the solid-liquid matrices with other, more dry, materials, such as recycled materials, or other cold-pressed solid-liquid matrices, which raises the initial weight percent solids content of the solid-liquid matrices to a level which is sufficient to provide structure to the solid-liquid matrices, so that the solid-liquid matrices may be free-standing, and have a body (a form which can be held). This level will generally be at least about 30% (about 30% or greater), but may be at least about 20%, at least about 25%, or at least about some other value between about 20% and about 30%, or could, in some instances, be a value below about 20% or a value above about 30%, depending upon the type of sludge being dewatered. This level may be determined in a manner known by those of skill in the art. Equipment which may be employed to increase the weight percent solids content of the solid-liquid matrices to the levels described above include any of the many pieces of equipment employed by those of skill in the art to squeeze water out of sludge or other similar materials, such as conventional room-temperature belt or filter presses, or the press roll assemblies described in U.S. Pat. No. 2,209,759 or U.S. Pat. No. 4,888,095, each of which is incorporated herein by reference. This procedure removes water from the solid-liquid matrices through the application of pressure, and in the form of a liquid. These pieces of equipment are commercially available from sources known by those of skill in the art.

Processing of solid-liquid matrices

Referring to FIG. 1, a solid-liquid matrix is loaded onto a conveyor belt 10. Conveyor belts useful in the present invention are the types and sizes commonly known in the art. Tensioning of the conveyor belt 10 is maintained with tensioning rollers 20. In this aspect of the invention, the conveyor belt is operated in a conventional manner and at a standard speed known in the art.

Figure 2:
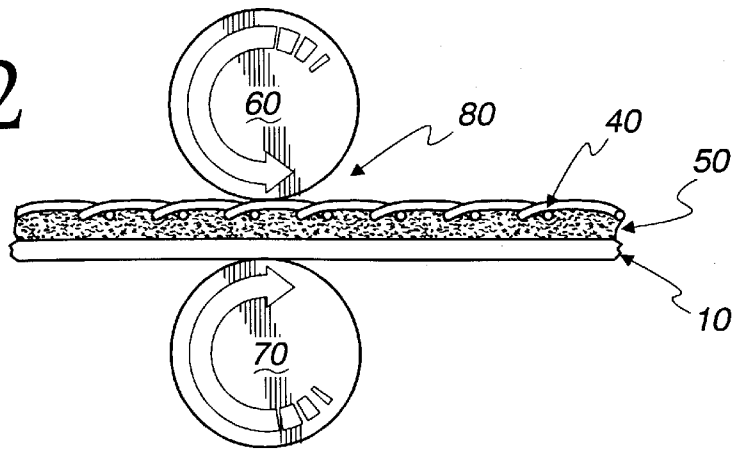
FIG. 2 is an expanded view of nip 80 located between upper heated roller 60 and lower cold roller 70 and further showing conveyor belt 10, liquid-solid matrix 50 and mesh 40.

Solid-liquid matrix placed on conveyor belt 10 is conveyed in the direction of arrow 30 between tensioning rollers 20. In an important alternative aspect of the invention, the tensioning rollers 20 serve as a guide for a mesh 40. The mesh 40 serves as an upper belt for placement onto the solid-liquid matrix as the solid-liquid matrix travels along the conveyor belt 10. The mesh 40 travels preferably in the direction of the conveyor belt 10 such that the solid-liquid matrix is sandwiched between the mesh 40 and the conveyor belt 10, as shown in FIG. 2, which is described in greater detail herein below. Application of mesh 40 to the solid-liquid matrix is effective for reducing in-plane spreading and maintaining the integrity of the liquid-solid matrix during the dewatering process. Otherwise, the matrix would be squeezed out of the plane of the machine surface before complete dewatering. In this aspect of the invention, the mesh may be a wire mesh or may be made out of any suitable material.

In an important aspect of the invention, solid-liquid matrix material is conveyed through a plurality of nips 80 of a plurality of impulse roller sets 120 in sequence. In a very important aspect, the process uses at least two impulse roller sets 120. However, additional roller sets may be used such that the solid-liquid matrix material is subjected to one or more additional applications of pressure and heat. As shown in FIG. 1, each impulse roller set 120 has an upper heated roller 60 and a lower cold roller 70. Each upper roller 60 include a doctor blade 90 which is effective for removing any sludge sticking to the roller.

The temperature of each upper heated roller 60 can be controlled independently. In this aspect of the invention, the temperature of each upper heated roller may range from about 21° C. to about 1000° C. The rollers may be heated by any convenient heat source including natural gas, electricity or by heat transfer from a heat-carrying medium such as steam. The lower cold rollers 70 are not heated and are maintained at ambient temperature. Also, the lower cold roller 70 may be grooved.

In another important aspect of the invention, the solid-liquid matrix is conveyed between each impulse roller set 120. The time between application of heat and pressure in each roller set can vary based on the distance between the roller sets and the speed of the conveyor belt. For example, in an exemplary embodiment, the time between application of heat and pressure is approximately thirty seconds, as described in Example 3 herein below. However, the time between such application of heat and pressure may vary from about 0.01 to about 180 seconds or greater. Therefore, it is appreciated by one skilled in the art the present invention is not so limited with respect to time between application of heat and pressure.

After passing through the last impulse roller set 120, mesh 40 is lifted off of the liquid-solid matrix 50 (FIG. 2) and dewatered liquid-solid matrix leaves the process in the direction of arrow 100.

FIG. 2 shows a close-up view of nip 80 in between upper heated roller 60 and lower cold roller 70. Upper heated roller 60 and lower cold roller 70 are spaced apart to provide a nip 80. In an important aspect, the nip 80 size is effective for providing a pressure ranging from about 45 psi to about 6000 psi. In a very important aspect, the nip size can be independently controlled in each roller set and may be different for each roller set.

The amount of pressure which is applied to the solid-liquid matrix is effective for forcing out a portion of the water from the solid-liquid matrix and generally ranges from about 45 psi to about 6000 psi, in an important aspect ranges from about 100 psi to about 2000 psi, and in a very important aspect ranges from about 300 psi to about 1400 psi. The application of pressure to the solid-liquid matrix removes water therefrom in the form of a liquid.

In connection with each roller set, pressure and heat are applied to the solid-liquid matrix for the same time period. This time generally ranges from about 0.01 seconds to about 20 seconds, in an important aspect ranges from about 0.14 seconds to about 10 seconds, and in a very important aspect ranges from about 0.25 seconds to about 3 seconds. However, the optimal time during which the pressure and heat are applied to a solid liquid matrix varies depending upon the amount of pressure being applied to the solid-liquid matrix, and the particular temperature being employed. For example, the optimal time is lower for a solid-liquid matrix which is being dewatered under conditions of a large amount of pressure and a high temperature. The optimal time, pressure, and temperature employed to dewater a particular solid-liquid matrix depends on each of the other conditions being employed, and depends upon whether an extended press nip is present in the apparatus being employed to dewater the solid-liquid matrix.

Figure 3A:
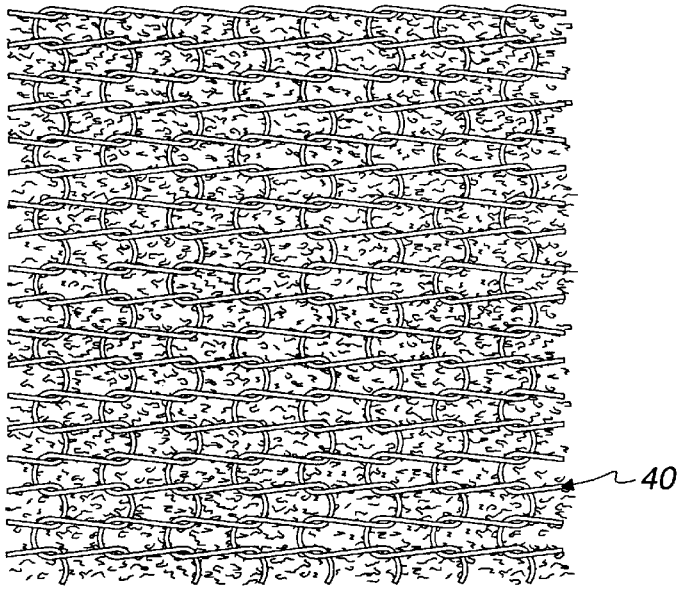
FIG. 3A illustrates a mesh 40 useful in carrying out the process of the present invention.

In a very important aspect of the invention, the mesh 40 has an interlocking structure as shown in FIG. 3A. The mesh can be made of any suitable material. The openings of the mesh are sized such that solid-liquid matrix is capable of passing through it, but is not so wide that the mesh does not maintain the integrity of the solid-liquid matrix. Advantageously, the use of mesh 40 as a top belt significantly reduces in-plane spreading during the dewatering process. Specifically, the function of the mesh 40 is to prevent sludge from spreading in the nip (FIG. 2). As a result of the pressure applied in the nip, the mesh 40 typically is embedded in the sludge during operation of the invention. Hence, the present invention may include a brush (not shown) or air or water jet (not shown) for cleaning the mesh or screen upon separation from the sludge.

Figure 3B:
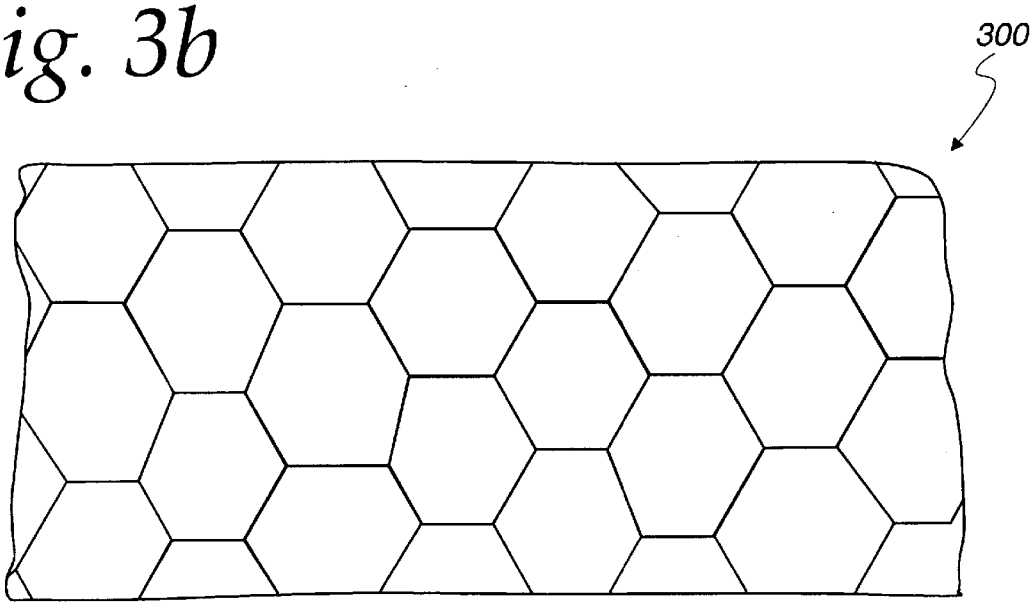
FIGS. 3B and 3C illustrates an upper belt with impressions, specifically a honeycomb configuration, useful in carrying out the process of the invention.
Figure 3C:
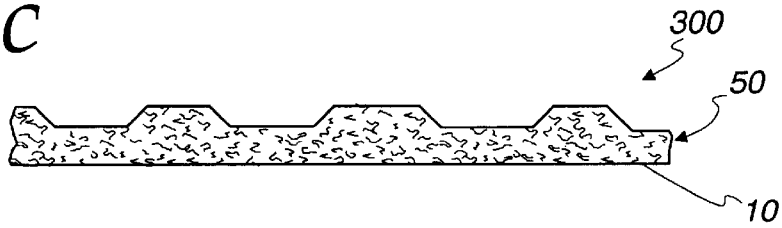

In a preferred embodiment of the present invention, the mesh 40 (FIG. 3A) can be replaced by a belt with impressions 300, such as belt with a honeycomb configuration, as shown in FIG. 3B. This belt with impressions 300 preferably is made of material, such as rubber, commonly used in the art and sized for use as an upper belt. Referring to FIG. 3C, the belt 300 is used in a similar manner as the mesh described above for placement onto the solid-liquid matrix 50 as the solid-liquid matrix 50 travels along the conveyor belt 10. The belt 300 travels preferably in the direction of the conveyor belt 10 such that the solid-liquid matrix 50 is sandwiched between the belt with impressions 300 and the conveyor belt 10. The belt with impressions 300 provides the advantage of preventing spreading and/or overflow of the solid-liquid matrix during the dewatering process.

It will be appreciated by one skilled in the art that the present invention is not limited to an upper belt containing honeycombs, but may also include a belt having impressions or indentations of any polygon or other shape, such as rectangular configuration, a circular configuration—i.e. bubbles, and so forth.

In the aspect of the invention where at least two or more impulse roller sets 120 are used, the parameters such as temperature and pressure can be independently controlled for each roller set depending on the liquid-solid matrix being treated and the amount of dewatering desired. During the multi-nip impulse drying process, the pressure preferably is progressively increased to maximize the amount of water extracted from the sludge/solid-liquid matrix. For example, briefly turning to Example 3 below, as additional impulses are implemented, the peak nip pressure is increased. In other words, impulse one may be at peak nip pressure of X psi, impulse pressure two may be at a peak nip pressure of Y psi, and impulse pressure three may be at a peak nip pressure of Z psi, where Z>Y>X. However, it is understood by one skilled in the art that the present invention is not limited to progressively increasing the pressure for each impulse, but one may instead use the same pressure for each impulse, where X, Y, and Z are equal. By employing this multi-nip process, the present invention more efficiently and effectively dewaters a solid-liquid matrix as compared to systems using a single-nip method.

The mechanisms of action of the dewatering of solid-liquid matrices which occur with the processes of the present invention are not currently known. However, two possible mechanisms of action are as follows: (i) the steam pressure generated at the interface of a hot roll and the solid-liquid matrices during the simultaneous application of pressure and heat to the solid-liquid matrices forces out a portion of the water from the solid-liquid matrices in the form of a liquid; and (ii) the viscosity of the water which is present in the solid-liquid matrices is reduced by the application of heat to the solid-liquid matrices.

EXAMPLES

Example 1

Dewatering of Paper Mill Primary Clarifier Sludge

In this experiment, samples of paper mill primary clarifier sludge were dewatered by the methods of the present invention. Simultaneous pressure and heat were applied to the sludge at a range of different pressures (0–1500 psi), at a temperature of 350° C. and at three different dwell times (0.24 seconds, 0.7 seconds and 1.5 seconds).

In order to compare the method of the invention employed in this experiment with state-of-the-art conventional cold-press methods for the dewatering of sludge, samples of the same paper mill primary clarifier sludge were additionally pressed at room temperature (20° C.) with a conventional cold press (Ashbrook Corp., Houston, Tex.). The different results obtained by the two different methods, as described hereinbelow, show the significant advantages of dewatering mill sludge by the methods of the present invention in comparison with state-of-the-art conventional cold-press methods.

A sample of primary sludge was obtained from Riverwood International in Macon, Ga. In order to give this sludge a "body" (a structure) and, thus, to increase the weight percent solids content thereof to about 30%, the sludge sample was belt-pressed with a conventional, room-temperature belt press from the primary clarifier at the Riverwood Macon Mill in Macon, Ga., and was then characterized as having 30% solids (30 weight percent solids of the total weight of the sludge sample).

In order to initially compare the methods of the present invention with currently-employed methods for dewatering solid-liquid mixtures, a sample of this belt-pressed mill sludge was sent to Ashbrooke Corp., where this sample was dewatered by conventional, state-of-the-art, room-temperature, belt-press methods using a 14-roll belt pres. This had the effect of increasing the weight percent solids content of the sludge sample from 30% to 39.0%. The Ashbrook Corp. belt press device is the state-of-the-art device in belt-press technology. The results of this belt pressing of the paper mill primary clarifier sludge samples with the Ashbrook Corp. device showed that cold belt pressing of this sludge with state-of-the-art equipment could achieve a maximum solids level of only 39%.

After a primary sludge sample from Riverwood International equivalent to the sludge pressed to a weight percent solids content of 39% by Ashbrook Corp. was prepared in the manner described above (given a body), a series of simulations of impulse drying were conducted wherein the electrohydraulic impulse drying press simulator shown in FIG. 4 was employed to dewater the sludge by impulse drying under the conditions described hereinbelow. This press simulator was obtained from MTS Systems Corp. (Guntersville, Ala.). For comparison purposes, other of these sludge samples were dewatered under the same conditions, with the exception of the temperature being at room temperature (20° C.).

FIG. 4 is a diagram of the electrohydraulic impulse drying press simulator employed in this experiment. The apparatus was designed to simulate the transient mechanical and thermal conditions experienced during the processes of impulse drying and double felted pressing. A programmable signal generator allows the electrohydraulic press to simulate a pressure history that the sludge would experience in a commercial impulse dryer configured on a long nip shoe press. Thermal conditions were simulated using a steel platen heated to the operating temperature of the process being employed (350° C.).

The electrohydraulic impulse drying press simulator removes water from sludge in the form of a liquid, and also in the form of a vapor, and includes a frame on which a hydraulic cylinder is mounted. The piston of the hydraulic cylinder actuates a heating head through a load cell. A heating platen, which is made of steel material, is present at the lower extremity of the heating head. Electric resistance heaters are disposed within the heating head for heating the platen, and a surface thermocouple is disposed in the heating head for measuring the surface temperature of the platen surface. A stand holds a felt pad against which the heating head is actuated by the hydraulic cylinder. Part of the water removal occurs as the result of steam formation and venting at the hot platen-vapor interface resulting from the hot pressing. The steam layer adjacent to the heated surface grows, and displaces water from the sludge in the form of a liquid.

After the laboratory press simulator was preheated, the hydraulic system was activated, resulting in the peak pressures described hereinbelow. The paper mill primary clarifier sludge samples were placed in the press simulator between the felt and the heated platen of the press simulator. A disposable blotter was used between the sludge samples and the felt to prevent the imbedding of the sludge samples in the felt. The felt ingoing moisture content (moisture content of the felt prior to the dewatering of the paper mill sludge samples) was 16% (16 weight percent moisture of the total weight of the felt).

The experimental conditions employed in this experiment were as follows:

| Experimental Condition | Value |
|---|---|
| Peak Pressures Tested | 0–1500 psi |
| Hot Platen Temperature | 20° C. (room temperature) and 350° C. |
| Dwell Times Tested | 0.24 seconds, 0.7 seconds and 1.5 seconds |

Sludge samples which had been subjected to impulse drying simulation were oven-dried, and then tested for solids content (as a percent weight of the total sludge sample). The sludge samples, and the blotters and felts of the electrohydraulic impulse drying press simulator, were weighted before cold pressing or impulse drying, after cold pressing or impulse drying, and after oven drying. From this weight data, water removal was calculated with the use of the following formulas:

Symbols and Terms:

$S_{in}$=Sludge ingoing weight $S_{out}$=Sludge outgoing weight $S_{oo}$=Sludge oven dry weight $B_{od}$=Blotter oven dry weight $BS_{oo}$=Sludge oven dry weight $BS_{out}$=Blotter+Sludge outgoing weight $F_{in}$=Felt ingoing weight $F_{out}$=Felt outgoing weight $F_{od}$=Felt oven dry weight $S_1$=Percent sludge ingoing solids content S=Percent sludge outgoing solids content $R_1$=Water receiver ingoing moisture $R_o$=Water receiver outgoing moisture LW=Percent liquid water removed Ingoing=Prior to being dewatered Outgoing=After being dewatered Formulas :

$$S_i = 100 \times \frac{(S_{in} + BS_{od} - B_{od})}{S_{in}}$$

$$S_o = 100 \times \left(\frac{S_{in}}{S_{out}}\right)$$

$$R_i = 100 - 100 \times \left(\frac{F_{out}}{F_{in}}\right)$$

$$R_o = 100 - 100 \times \left(\frac{F_{od}}{(F_{out} + BS_{out} - B_{od} - \left(\frac{BS_{od} - B_{od}}{S_o}\right)}\right)$$

$$LW = 100 \times \left(\frac{\text{Receiver Weight Gain}}{\text{Sludge Weight Loss}}\right)$$

$$= 100 \times \left[\frac{F_{out} + BS_{out} - B_{od} - (BS_{od} - B_{od})/S_o - F_{in}}{S_{in} - S_{out} - (BS_{od} - B_{od})(S_o)}\right]$$

Figure 5:
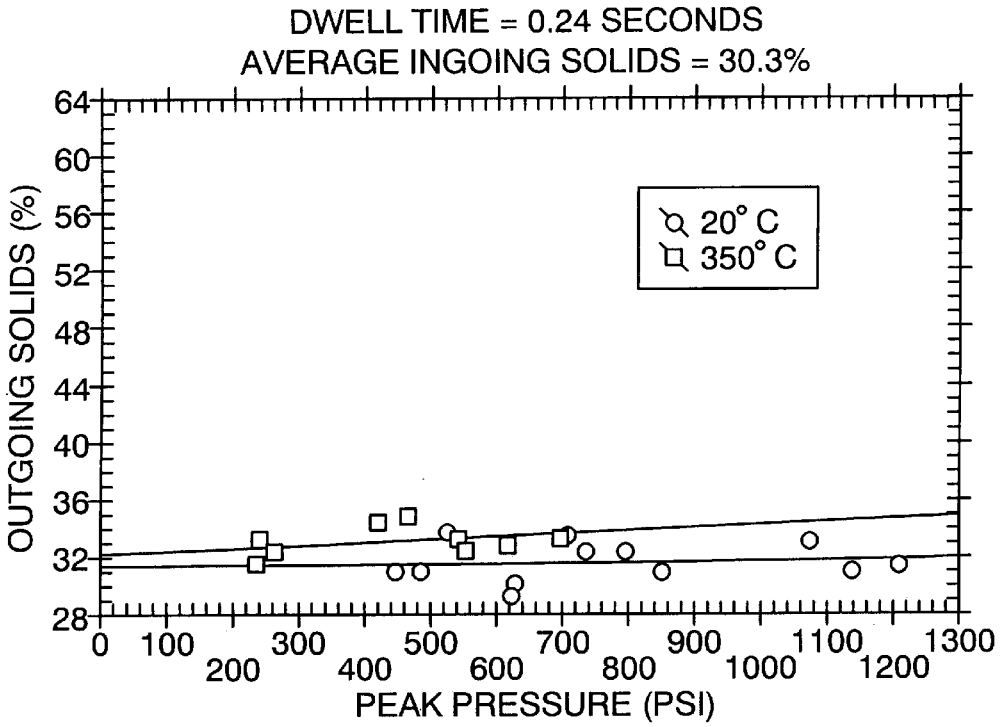
FIG. 5 is a graph of peak pressure (in psi units) versus the percent of outgoing solids content of paper mill primary clarifier sludge samples dewatered at a dwell time of 0.24 seconds and at two different temperatures (room temperature (20° C.) and 350° C.) in the experiment described in Example 1 hereinbelow.
Figure 6:
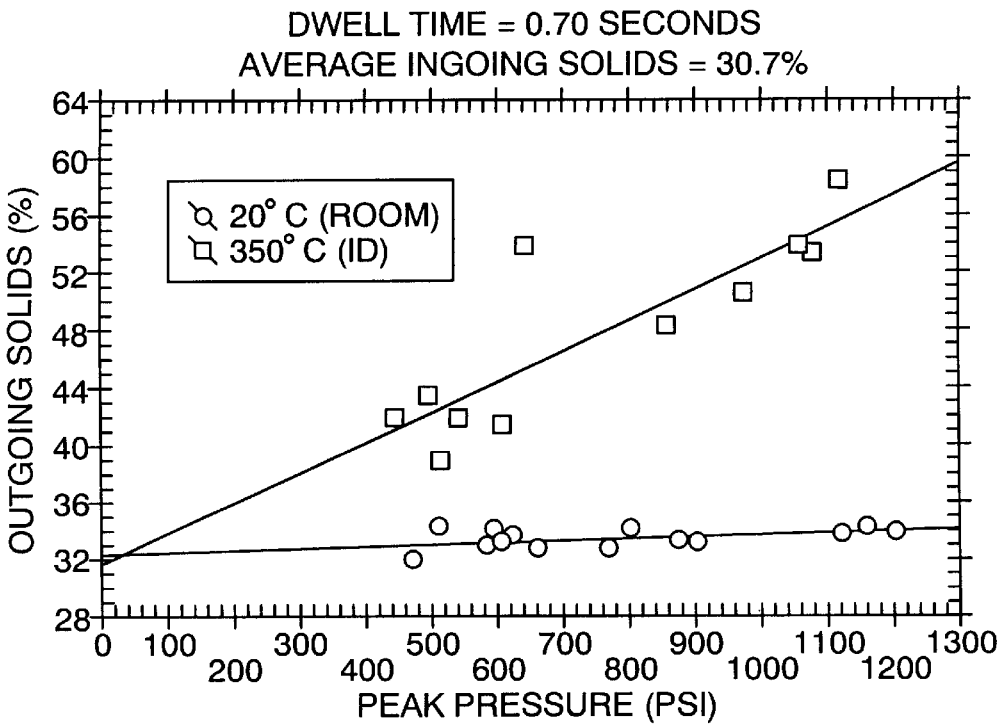
FIG. 6 is a graph of peak pressure (in psi units) versus the percent of outgoing solids content of paper mill primary clarifier sludge samples dewatered at a dwell time of 0.7 seconds and at two different temperatures (room temperature (20° C.) and 350° C.) in the experiment described in Example 1 hereinbelow.
Figure 7:
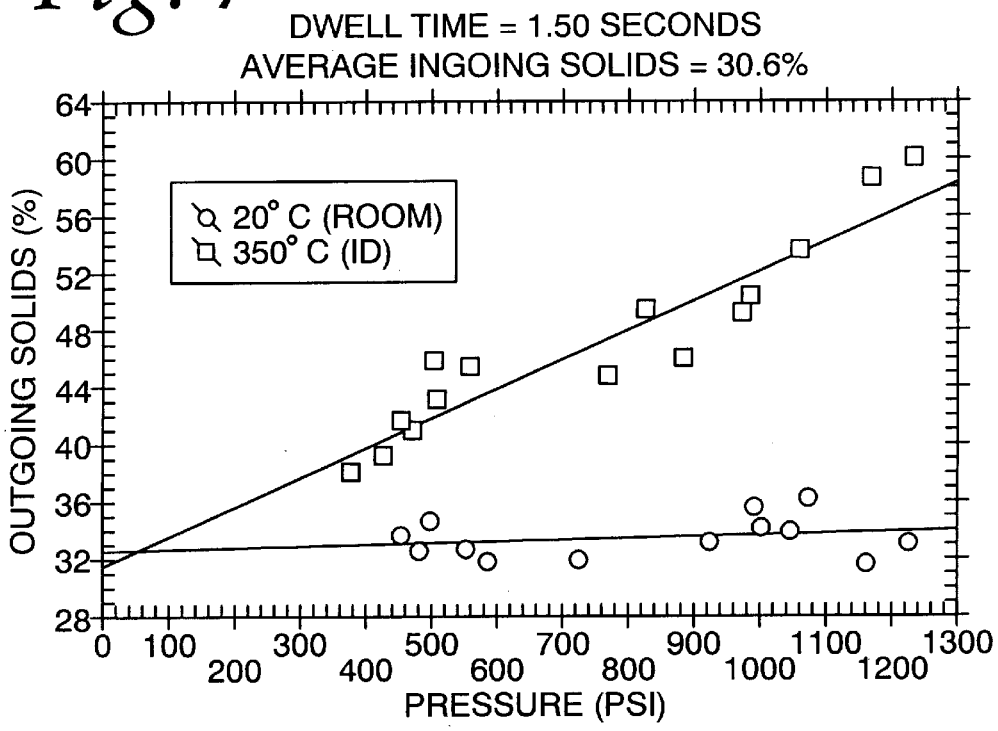
FIG. 7 is a graph of peak pressure (in psi units) versus the percent of outgoing solids content of paper mill primary clarifier sludge samples dewatered at a dwell time of 1.5 seconds and at two different temperatures (room temperature (20° C.) and 350° C.) in the experiment described in Example 1 hereinbelow.

FIGS. 5, 6 and 7 graphically show the weight percent solids content of the outgoing (after being dewatered in the manners described above) sludge samples of the total weight of the outgoing sludge samples after the sludge samples were dewatered in the manner described above. These figures show that there is a direct correlation between the percent of outgoing solids of the sludge samples and the percent of water removed from the sludge samples.

FIG. 5 shows that, at the dwell time of 0.24 seconds, there was not a substantial increase in the percent of outgoing solids of the sludge samples at the two pressures and temperatures tested. However, FIG. 6 shows that, when the dwell time was increased from 0.24 seconds to 0.70 seconds, there was a significant increase in the percent of outgoing solids of the sludge samples tested at a temperature of 350° C., and that, at a temperature of 350° C., the percent of outgoing solids of the sludge samples increased significantly as the pressure was increased.

FIG. 7 shows that similar results were obtained to those shown in FIG. 6 when the dwell time was further increased to 1.50 seconds. At the higher temperature of 350° C., a significant amount of steam was formed and vented during pressing. Some of the water removed from the sludge samples may have been the result of flash drying in the press. (As the impulse drying is terminated before the sludge samples are completely dried, water remaining in the sludge may "flash" to vapor during nip decompression).

Figure 8:
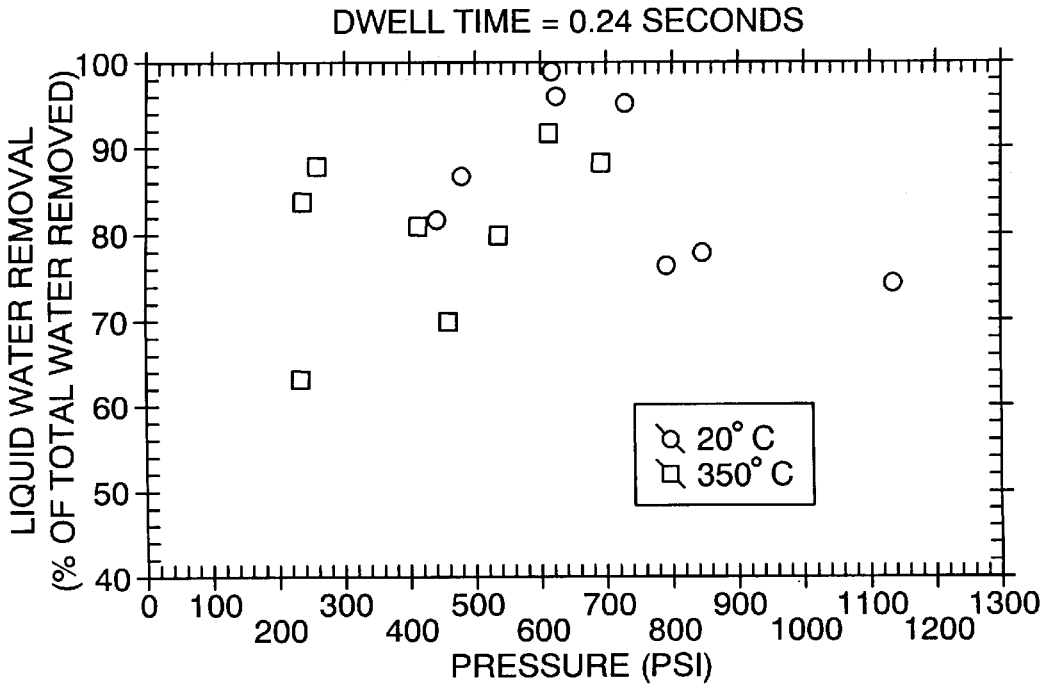
FIG. 8 is a graph of peak pressure (in psi units) versus the percent felt moisture gain the for felt of the electrohydraulic impulse drying laboratory press simulator shown in FIG. 1 at a dwell time of 0.24 seconds and at two different temperatures (room temperature (20° C.) and 350° C. in the experiment described in Example 1 hereinbelow.
Figure 9:
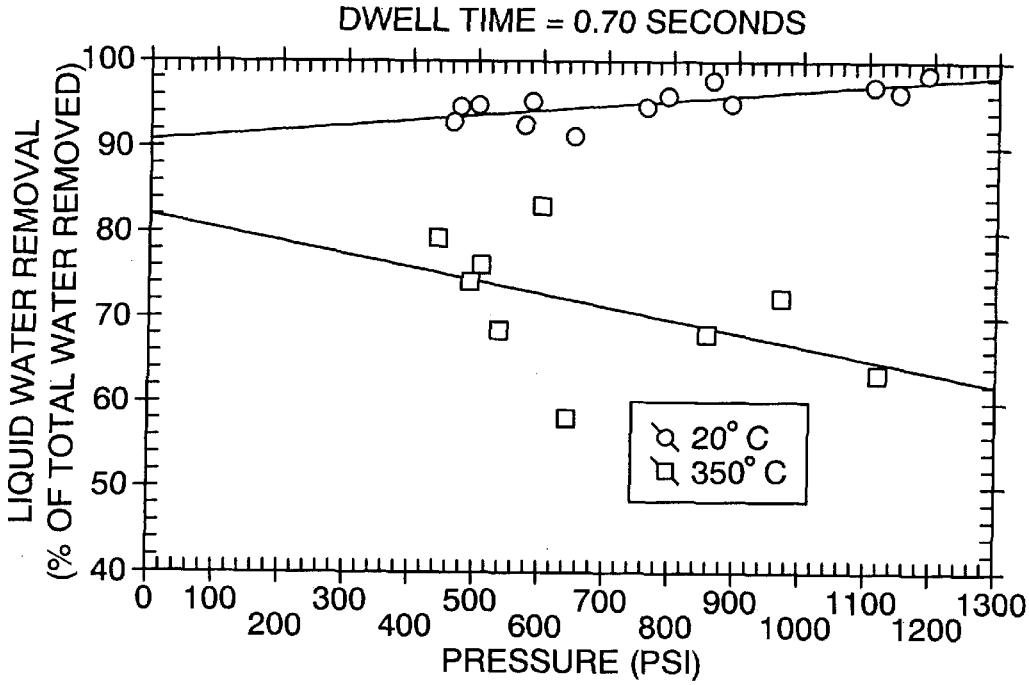
FIG. 9 is a graph of peak pressure (in psi units) versus the percent felt moisture gain for the felt of the electrohydraulic impulse drying laboratory press simulator shown in FIG. 1 at a dwell time of 0.7 seconds and at two different temperatures (room temperature (20° C.) and 350° C.) in the experiment described in Example 1 hereinbelow.
Figure 10:
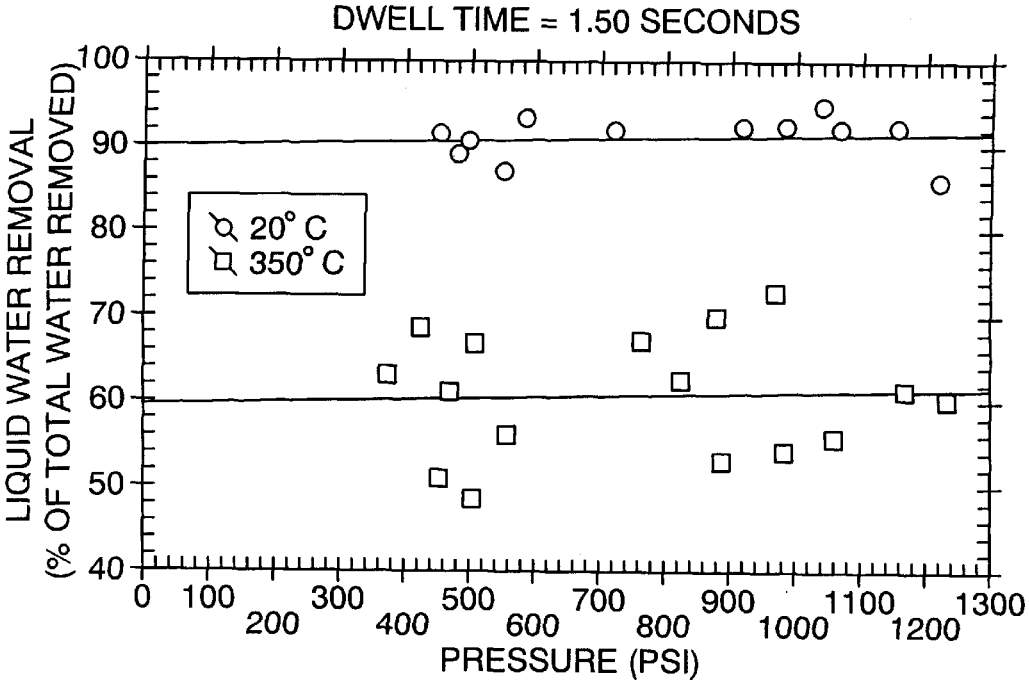
FIG. 10 is a graph of peak pressure (in psi units) versus the percent felt moisture gain for the felt of the electrohydraulic impulse drying laboratory press simulator shown in FIG. 1 at a dwell time of 1.5 seconds and at two different temperatures (room temperature (20° C.) and 350° C.) in the experiment described in Example 1 hereinbelow.

FIGS. 8, 9 and 10 each show the percent moisture gain in the felt and blotter (the percent weight increase in the moisture content of the felt and blotter of the total felt and blotter weight) for the felt and blotter of the laboratory press simulator employed in this experiment at the two different temperatures of 20° C. and 350° C., and different pressures, tested. This shows the amount of water which was absorbed by the felt/blotter system of the press simulator during the impulse drying of the sludge samples. When steam is not formed and vented during pressing, there is a direct correlation between the percent moisture gain in the felt and blotter and the percent of water removed from the sludge samples. The percent moisture gain in the felt and blotter was calculated as a percentage of the water lost by the sludge.

FIG. 8 shows that, at a dwell time of 0.24 seconds, there was not much difference with respect to the percent moisture gain in the felt and blotter between sludge samples cold pressed at room temperature (20° C.) and sludge samples heated to a temperature of 350° C. with a hot platen at a temperature of 350° C.

FIG. 9 shows that, when the dwell time was increased from 0.24 seconds to 0.7 seconds, for sludge samples heated to a temperature of 350° C., there was significantly less percentage water absorbed by the felt and blotter, with up to 40% of the water being lost as steam. FIG. 6 also shows that, at a temperature of 350° C., the percent moisture gain in the felt and blotter decreases significantly as the pressure increases.

FIG. 10 shows that, when the dwell time was increased from 0.7 seconds to 1.50 seconds, for sludge samples heated to a temperature of 350° C., there was significantly less percentage water absorbed by the felt and blotter in comparison with sludge samples which were pressed at room temperature, with up to 40% of the water being lost as steam. Unlike FIG. 9, however, FIG. 10 does not show, at a temperature of 350° C., a significant decrease in the percent moisture gain in the felt and blotter as the pressure increases.

The conclusions which may be drawn from this experiment are as follows:

(1) The dewatering of paper mill primary clarifier sludge samples by the method of the invention described in this experiment (at a temperature of 350° C.) resulted in the removal of significantly more water from the mill sludge samples than that which was removed from the same mill sludge samples by the conventional cold pressing of the mill sludge samples at room temperature (20° C.), even when state-of-the-art belt-press devices were employed. The percent of outgoing solids content of the mill sludge samples (weight percent solids content of the mill sludge samples after being dewatered) increases by from about three to about twenty-four percent when the method of the invention described in the experiment (at a temperature of 350° C.) is employed in comparison with the conventional cold pressing of the mill sludge samples at room temperature (20° C.). From about 5% to about 40% of the water removed from the mill sludge samples in accordance with the methods of the invention is in the form of steam, with more steam being generated as the dwell time and pressure are increased.

(2) As is shown in FIG. 5, at the shorter dwell time of 0.24 seconds, the method of the invention described in this experiment (at a temperature of 350° C.) offered some advantage over the conventional cold press methods for dewatering mill sludge samples at room temperature (20° C.).

(3) As is shown in FIG. 6, at the increased dwell time of 0.7 seconds, the advantages of the method of the invention described in this experiment (at a temperature of 350° C.) in comparison with conventional cold press methods for dewatering sludge at room temperature (20° C.) were significant. The benefits of heating the mill sludge samples at this dwell time at a temperature of 350° C. increased with increasing pressure (i.e., more water was removed from the sludge samples at a dwell time of 0.70 seconds and at a temperature of 350° C. and the pressure was increased from 0 to 1300 psi). As is shown in FIG. 6, at a pressure of 1300 psi, the outgoing mill sludge samples had a content which was about 60% solid, as compared with outgoing mill sludge samples having a content which was about 34% solid for sludge samples pressed for the same dwell time, and at the same pressure, but at room temperature (20° C.). Further, the solids content of the sludge samples initially dewatered with the state-of-the-art Ashbrook Corp. room-temperature belt-press device was only 39%. Approximately one-third of the water removed from the mill sludge samples by impulse drying in accordance with the method of the invention described in this experiment (at a temperature of 350° C.) was removed in the form of steam, with the rest of the water being removed from the mill sludge samples in the form of a liquid, and being absorbed from the mill sludge samples by the felt of the press simulator. Thus, excluding the water removed from the mill sludge samples in the form of steam, dewatering of the mill sludge samples at a temperature of 350° C. resulted in about a 17% increase in water removal from the mill sludge samples in comparison with cold pressing water from the same mill sludge samples at room temperature (20° C.).

(4) As is shown in FIG. 7, similar results were obtained as described above for a dwell time of 0.70 seconds when a dwell time of 1.5 seconds was employed. At a pressure of 1300 psi, a temperature of 350° C. and a dwell time of 1.5 seconds, the outgoing mill sludge samples had a content which was about 58% solid. In contrast, the same mill sludge samples which were pressed for the same dwell time, and at the same pressure, but at room temperature (20° C.) resulted in outgoing mill sludge samples having a content which was about 34% solid.

Example 2

Dewatering of Municipal/Industrial Sludge

In this experiment, wet sludge consisting of mixed municipal and industrial streams was obtained from the City of Milwaukee. In order to test the methods of the present invention on sludge samples having a higher initial weight percent solids content (weight percent solids content prior to being dewatered according to the methods of the present invention) than the sludge samples described in Example 1, one part of this wet sludge was mixed with two parts of dry sludge (recycled material). This produced a sludge having an ingoing (before impulse drying) weight percent solids content of about 75%.

The same impulse drying equipment and techniques employed in Example 1 were employed in this experiment.

In the first part of this experiment, a dwell time of 0.7 seconds was employed, and the pressure was varied from 200 psi to 1400 psi. This part of the experiment was performed once at a temperature of 23° C., and a second time at a temperature of 350° C.

In a second part of this experiment, a temperature of 350° C. was employed, five different dwell times were employed (0.7 seconds, 0.6 seconds, 0.5 seconds, 0.35 seconds and 0.14 seconds), and the pressure was varied from 200 psi to 1400 psi.

Figure 11:
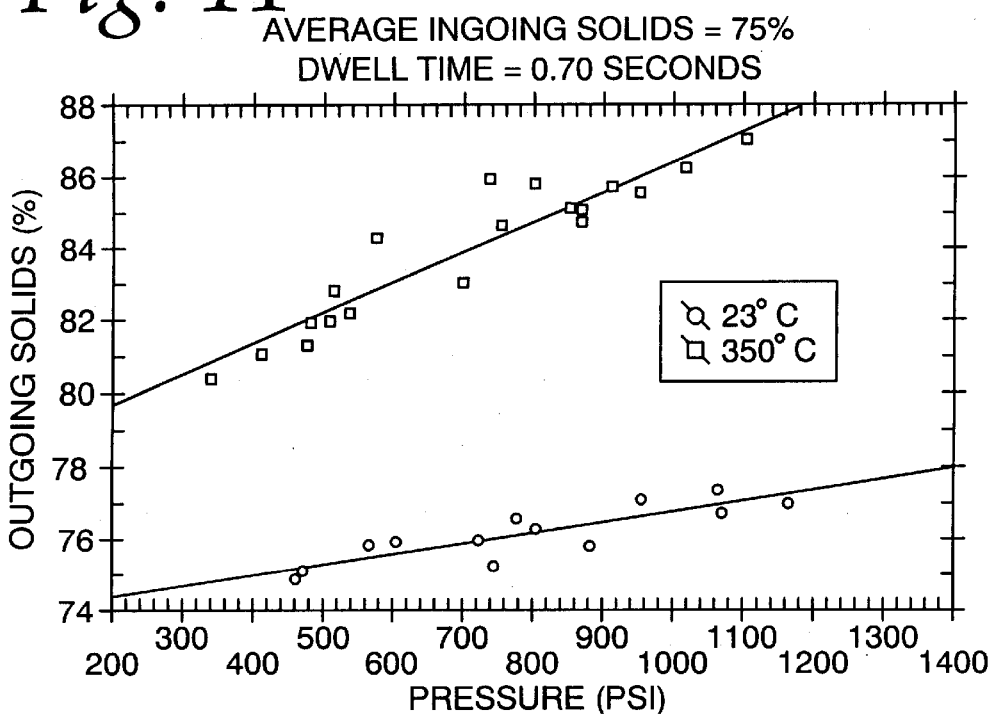
FIG. 11 is a graph of peak pressure (in psi units) versus the percent of outgoing solids content of municipal/industrial sludge samples dewatered at a dwell time of 0.7 seconds and at two different temperatures (23° C. and 350° C.) in the experiment described in Example 2 hereinbelow.
Figure 12:
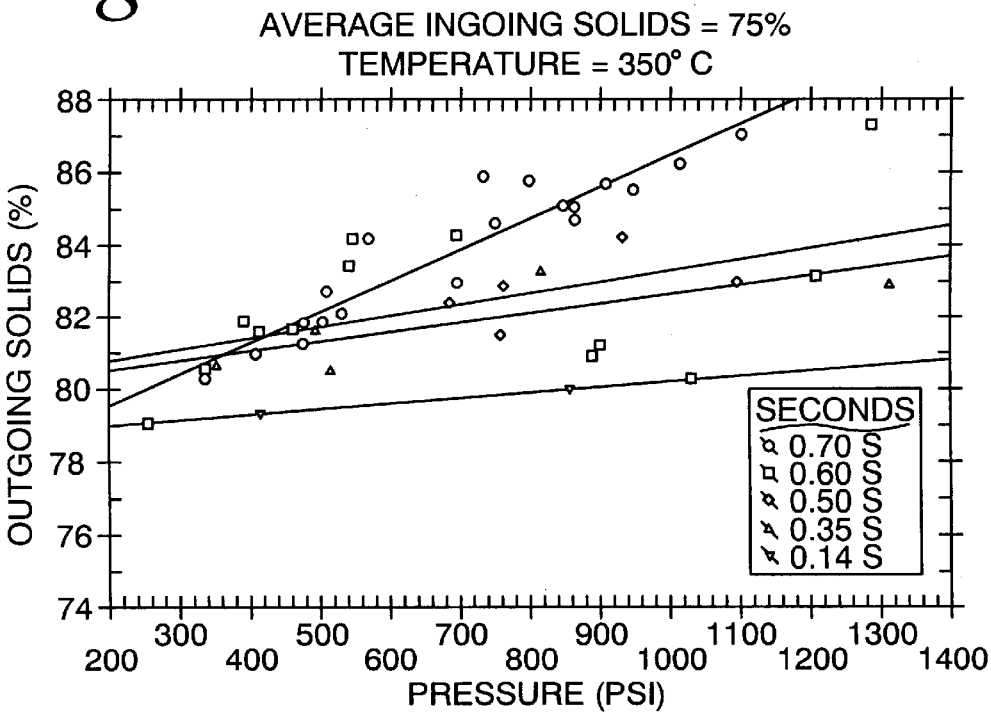
FIG. 12 is a graph of peak pressure (in psi units) versus the percent of outgoing solids content of municipal/industrial sludge samples dewatered at five different dwell times (0.7 seconds, 0.6 seconds, 0.5 seconds, 0.35 seconds and 0.14 seconds) and at a temperature of 350° C. in the experiment described in Example 2 hereinbelow.

The results of this experiment are present in FIGS. 11 and 12.

FIG. 11 is a graph which shows the results of the first part of this experiment. FIG. 11 shows that, at a temperature of 350° C., a dwell time of 0.7 seconds and a pressure of about 1175 psi, the outgoing (after impulse drying) solids content of the municipal sludge samples was about 86%. FIG. 11 also shows that, at a temperature of 23° C., a dwell time of 0.7 seconds and a pressure of about 1400 psi, the percent of outgoing solids was increased from about 75% to about 78%. In both cases (at the two different temperatures), a proportional increase in the outgoing solids content of the municipal sludge samples as a percent weight of the total content of the outgoing sludge samples is seen as the pressure is increased, with a more significant increase in the outgoing solids content of the municipal sludge samples occurring at the higher temperature of 350° C.

FIG. 12 is a graph which shows the results of the second part of this experiment. FIG. 12 shows that, at a temperature of 350° C., a dwell time of 0.7 seconds, and a pressure of about 1175 psi, the percent of outgoing solids content of the municipal sludge samples was increased from about 75% to about 88%. FIG. 12 also shows that, at each of the five dwell times tested, there was a proportional increase in the percent of outgoing solids content of the municipal sludge samples as the pressure was increased, with more significant increases occurring as the dwell time was increased from 0.14 seconds to 0.70 seconds.

Example 3

Dewatering of Paper Mill Primary Clarifier Sludge with Municipal Impulses

Sludge as described in Example 1 was impulse-dried as described in Example 1 and then further impulse dried after a delay of 30 seconds. The results in Table 1 show that a significant increase in outgoing solids over "one-event" impulse drying is obtained if the sludge is contacted by the hot surface two or more times.

TABLE 1

Dewatering of Riverwood sludge with multiple impulses at 300° C.

| | peak nip pressure (psi) | | | solids out |
|---|---|---|---|---|
| No. of impulses | 1st Impulse | 2nd Impulse[1] | 3rd Impulse[1] | (percent) |
| 1 | 390 | | | 42.58 |
| 1 | 430 | | | 43.5 |
| 1 | 470 | | | 42.92 |
| 1 | 570 | | | 44.49 |
| 1 | 700 | | | 44.14 |
| 1 | 800 | | | 45.76 |
| 1 | 1000 | | | 46.07 |
| 1 | 1600 | | | 48.12 |
| 1 | 1000 | | | 45.66 |
| 2 | 470 | 606 | | 50.9 |
| 2 | 630 | 1034 | | 55.6 |
| 2 | 697 | 1148 | | 54.8 |
| 2 | 741 | 1399 | | 59.01 |
| 2 | 791 | 1520 | | 59.24 |
| 2 | 1688 | 1760 | | 61.3 |
| 2 | 990 | 1695 | | 59.35 |
| 2 | 1339 | 1810 | | 60.04 |
| 3 | 371 | 469 | 600 | 57.35 |
| 3 | 415 | 518 | 812 | 56.5 |
| 3 | 664 | 932 | 1111 | 62.02 |
| 3 | 686 | 938 | 1294 | 61.42 |
| 3 | 974 | 1430 | 1520 | 68.27 |
| 3 | 896 | 1505 | 1640 | 67.4 |
| 3 | 1410 | 1591 | 1669 | 68.28 |

[1]30 second delay after the preceding impulse

While the various aspects of the present invention are described herein with some particularity, those of skill in the art will recognize numerous modifications and variations which remain within the spirit of the invention. These modifications and variations are within the scope of the invention as described and claimed herein.

What is claimed is:

1. A system for reducing in-plane spreading of a solid-liquid matrix during impulse drying, comprising:

at least one pair of rotating impulse rollers, said pair consisting of an upper heated roller and a lower roller;

the pair of rotating impulse rollers spaced apart to provide a nip effective for providing a predetermined pressure;

a conveyor belt moving in a predetermined direction and positioned between the pair of rotating impulse rollers, the conveyor belt for transporting the solid-liquid matrix through the nip of the pair of rotating impulse rollers; and an upper belt containing impressions to reduce in-plane spreading of the solid-liquid matrix;

the upper belt moving in the predetermined direction of the conveyor belt and positioned between the upper heated roller and the conveyor belt.

2. The system of claim 1, wherein the impressions in the upper belt is a honeycomb configuration.

3. The system of claim 1, wherein the upper belt is applied to the solid-liquid matrix during passage through the nip of the pair of impulse rollers such that the solid-liquid matrix is sandwiched between the upper belt and the conveyor belt.

4. The system of claim 1, wherein the predetermined pressure ranges from about 45 psi to about 6000 psi.

5. A system for reducing in-place spreading of a solid-liquid matrix during impulse drying, comprising:

at least one pair of rotating impulse rollers, said pair consisting of an upper heated roller and a lower roller;

the pair of rotating impulse rollers spaced apart to provide a nip effective for providing a predetermined pressure;

a conveyor belt moving in a predetermined direction and positioned between the pair of rotating impulse rollers, the conveyor belt for transporting the solid-liquid matrix through the nip of the pair of rotating impulse rollers; and a mesh to reduce in-plane spreading of the solid-liquid matrix;

the mesh moving in the predetermined direction of the conveyor belt and positioned between the upper heated roller and the conveyor belt.

6. The system of claim 5, wherein the mesh is applied to the solid-liquid matrix during passage through the nip of the pair of impulse rollers such that the solid-liquid matrix is sandwiched between the mesh and the conveyor belt.

7. The system of claim 5, wherein the predetermined pressure ranges from about 45 psi to about 6000 psi.

* * * * *